United States Patent [19]

Errichiello

[11] 4,314,716

[45] Feb. 9, 1982

[54] BOOK BINDERS WITH TABS

[76] Inventor: Dominic R. Errichiello, 389 Meadowlark Rd., Bloomingdale, Ill. 60108

[21] Appl. No.: 63,830

[22] Filed: Aug. 6, 1979

[51] Int. Cl.[3] ..... B42D 3/00

[52] U.S. Cl. ..... 281/29; 402/75

[58] Field of Search ..... 281/29, 34, 36, 37; 402/48, 51, 52, 75

[56] References Cited

U.S. PATENT DOCUMENTS

| | | | |
|---|---|---|---|
| 79,560 | 7/1868 | Emerson | 402/75 X |
| 794,529 | 7/1905 | Methven | 402/75 X |
| 840,979 | 1/1907 | Whetham | 281/49 |
| 914,953 | 3/1909 | Hartmann | 402/75 X |
| 1,275,104 | 8/1918 | Taylor | 402/75 X |
| 1,941,634 | 1/1934 | Steinthal | 402/75 X |
| 3,111,126 | 11/1963 | Brinkman | 402/75 X |
| 3,716,256 | 2/1973 | Moore | 281/29 |
| 3,972,632 | 8/1976 | Carter | 402/75 X |
| 4,000,951 | 1/1977 | Agnew | 402/75 X |

*Primary Examiner*—Paul A. Bell
*Assistant Examiner*—John S. Brown
*Attorney, Agent, or Firm*—Keil & Witherspoon

[57] ABSTRACT

Book binders with a front cover panel, a rear cover panel, and a spine which is a cross wall connected along opposite longitudinal edges thereof by living hinges to said front cover panel and said rear cover panel; a first, rectangular strip, having three free sides, mounted on and projecting substantially at a right angle to the spine near a living hinge, a second, rectangular strip, having three free sides, mounted on and projecting substantially at a right angle to the spine near the other living hinge, said strips being substantially parallel, whereby edge portions of pages of a book may be inserted between said opposed strips and mounted in said book by adhesive or by stitching, stapling or the like through said strips and said edge portions.

2 Claims, 4 Drawing Figures

BOOK BINDERS WITH TABS

BACKGROUND OF THE INVENTION

The subject invention pertains to improvements in book binders of the so-called hard cover type, and more particularly pertains to new techniques and structures by which old books, from which the covers have been torn off, and new books being bound for the first time can be bound quickly and easily.

Book binding has been a very slowly advancing art for many centuries. There have been no radical changes in the book binding art for many, many years.

The most common method of mounting stitched or stapled, bound pages of a book in the outer covering—the binder composed of front and rear cover panels and the spine—is to attach relatively heavy, outermost sheets of the bound pages to the inside faces of the front and rear cover panels. The sheets which hold the bound pages in the binder are respectively once-folded sheets with one "page" in the binding and the other "page" secured to the inside face of the cover panel—the fold serving as the hinge between the bound pages and the respective cover panels. Books which are used repeatedly, e.g., library books, reference books, dictionaries, cook-books, manuals, etc. tend ultimately to tear at the fold and then either require a new binder or other remedial measures to re-bind the pages in the old binder, if it is not damaged or too worn.

Therefore, the binders of the subject invention have widespread use as a re-binder of worn or torn bound volumes. Another use is that of serving as the original binder for new books.

Almost all books with hard covers are bound by printing two, side-by-side pages of the book on one or both sides of a paper sheet, which is then folded vertically midway between the side-by-side printed pages. A number of these folded sheets are assembled in page number sequence, and the group of sheets are stitched at their collective fold lines to a spine backing by a vertical line of stitching. Then another group of folded sheets, again with numerical page sequence, are assembled and stitched at their collective fold lines to the spine backing in a vertical line of stitching next to the last line of stitching.

With the strips of the invention used as tabs through which the pages are stitched or stapled transversely to the plane of the pages, fold lines between pages are not required. Single pages can be bound together by the transverse stitching or stapling.

RELATED APPLICATIONS

Some aspects of the subject book binders are disclosed in some of my other co-pending applications. My application Ser. No. 63,863, filed Aug. 6, 1979 discloses the concept of molding the entire book binder from a thermoplastic polymer. The employment of one piece moldings of the front and rear cover panels, connected by integrally molded living hinges to opposite longitudinal edges of the spine, can simplify the manufacture of the spine and the cover panels in the desired, attractive color. Living hinges are also disclosed in the earlier application. The spine and the front and rear cover panels are an integral molding of a thermoplastic polymer, preferably low density polypropylene or polypropylene/polyethylene copolymers or mixtures. These polymers offer the advantage of forming living hinges by molding lines of weakness, e.g., a groove or two opposed grooves in the plastic matrix, and flexing the molding along the lines of weakness while it is still hot to cause molecular orientation of the polymer at the lines of weakness.

BRIEF DESCRIPTION OF THE INVENTION

The book binders of the invention comprise integral, plastic moldings of a front cover panel, a rear cover panel, and a spine. The spine comprises a cross wall hingedly connected along opposite longitudinal edges thereof to said front cover panel and said rear cover panel by first hinge means, preferably a living hinge, forming the connection between said front cover panel and said spine and second hinge means, also preferably a living hinge, forming the connection between said rear cover panel and said spine.

A first, rectangular strip or tab, having three free sides, extends longitudinally along the inner face of the spine at right angles thereto along a line adjacent to or coinciding with said first hinge means. A second, rectangular strip or tab, having three free sides, extends longitudinally along the inner face of the spine at right angles thereto along a line adjacent to or coinciding with said second hinge means. The resulting parallel, opposed, spaced strips are provided so that edge portions of pages of a book may be inserted between said opposed strips and mounted in said book by stitching, stapling, or the like through said strips and said edge portions or by adhesive. The hinge-adjacent parts of the front and rear cover panels have rectangular cavities of the same or slightly larger size as the strips to provide pockets into which the strips fit when the book is closed.

In an alternate form, the spine is a two-piece molding consisting of (a) two parallel, spaced rectangular walls depending at right angles from a front spine panel or strip and forming a groove and (b) a single, rectangular wall extending at a right angle from a rear, spine panel or strip and forming a tongue which slidably fits in the groove. This tongue and groove arranged allows the spine to be varied in width to accommodate different thickness of the stacked pages to be bound. This feature is disclosed in greater detail in my co-pending application Ser. No. 63,831, filed Aug. 6, 1979.

PRIOR ART

The prior art disclosed in my aforesaid copending application Ser. No. 63,831, filed Aug. 6, 1976 is the closest art. There is no prior art which teaches the use of integrally molded, rectangular strips or tabs extending from the spine and serving as members to which the pages of a book are fastened, e.g., by stitching, stapling or the like.

ILLUSTRATED EMBODIMENTS

Preferred forms of the book binders of the invention are illustrated in the drawings, wherein.

Figure 1:
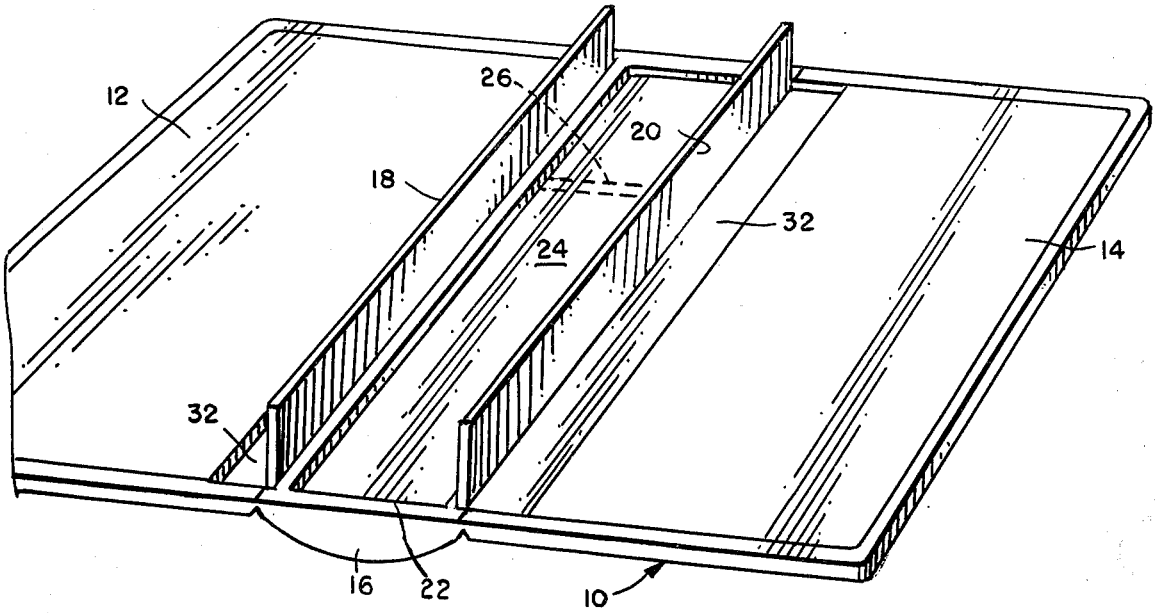
FIG. 1 is a front, perspective view of a first binder embodiment with the cover panels lying open.

Referring to the drawings, the book binder 10 comprises an integral molding of a thermoplastic polymer of a front cover panel 12, a rear cover panel 14, a spine 16, and a pair of parallel, rectangular strips 18, 20 respectively extending longitudinally along both sides of the spine. The strips 18, 20 are thin enough that they can flex.

The binders of the invention are intended to be used chiefly as replacement binders for books whose original binders have been damaged or torn loose from the pages. The front face 22 of the spine has a rectangular cavity 24 to receive the rear edges of the book pages 34.

Figure 2:
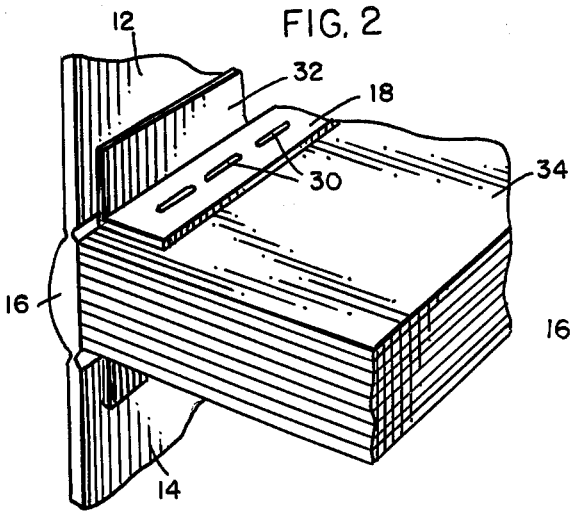
FIG. 2 is a fragmentary, perspective view of the binder of FIG. 1 and the pages bound therein by stapling or stitching.

With the binder in the fully open position shown in FIG. 1, the stitching or stapling 30 (FIG. 2), or an adhesive, is used to secure the pages 34 between the strips. The stitching or stapling 30 extends through the strips and the pages whereas adhesive is applied to the bottom wall of the cavity 24 and to the facing sides of strips 18, 20.

Figure 4:
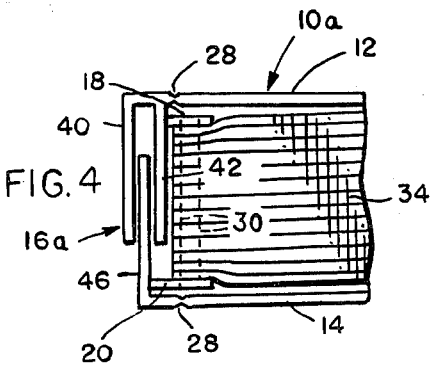
FIG. 4 is a fragmentary, end elevation of another embodiment of a binder with a width-variable spine.

The embodiment of FIG. 4 has a width-variable spine. Here, the spine 16*a* and the binder 10*a* are made as two separate moldings. One cover panel 12 is hingedly mounted by the integrally molded, living hinge 28 to a pair of parallel, rectangular walls 40, 42, the space between which serves as a groove to receive slidably a rectangular tongue wall 46. This tongue and groove combination allows the width of the spine to be varied by sliding the tongue transversely into and out of the groove. The tongue wall 46 is hingedly connected by the living hinge 28 to the rear cover panel 14.

The tongue wall 46 has a strip 20 molded integrally therewith and substantially at a right angle thereto. The wall 42 has a strip 18 molded integrally therewith and substantially at a right angle thereto. Pages 34 are secured in the binder 10*a* by stitching or stapling through the strips 18, 20 and the edge portions of the pages (or by use of an adhesive) substantially as described above with respect to FIGS. 1–3. The embodiment of FIG. 4 has the advantage of being useful to bind pages of substantial variance in thickness, whereas that of FIGS. 1–3 can accommodate thicknesses varying only in a small range.

The width variable spine feature of FIG. 4 is disclosed in more detail in my copending application Ser. No. 63,831, filed Aug. 6, 1979, and is incorporated herein by reference as if it were set forth in its entirety.

Figure 3:
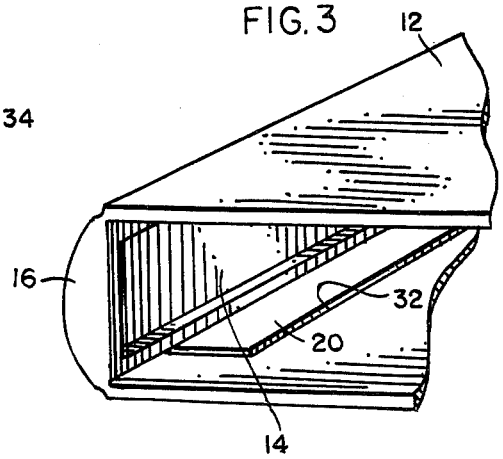
FIG. 3 is a fragmentary, perspective view of the binder (without pages therein) in the closed position.

If desired, the inner faces of the cover panels 12, 14 may each have a shallow, rectangular cavity 32 adjacent to and coextensive with the rectangular strips 18, 20 to provide recesses in which the strips can lie when the binder is in the closed position (FIG. 3). The spine 16 may have a longitudinal cavity in the outer face in which is mounted a spine insert subdivided by a transverse hinge 26 which allows the lower segment of the insert to swing outward and for an easel-like stand. Details of this feature are disclosed in my copending application Ser. No. 63,863, filed Aug. 6, 1979.

It will be appreciated from the foregoing that the invention herein can take many forms other than the preferred forms shown in the drawings and that the invention as herein claimed is not limited to the illustrated embodiments.

I claim:

1. A book binder comprising a front cover panel, a rear cover panel, and a spine; said spine comprising a cross wall hingedly connected along opposite longitudinal edges thereof to said front cover panel and said rear cover panel; a first, rectangular strip or tab having three free sides, extending at right angles to and longitudinally along the inner face of said spine; a second, rectangular strip or tab, having three free sides, extending at right angles to and longitudinally along said inner face in spaced, parallel relationship to said first strip or tab, whereby edge portions of pages of a book may be inserted between said strips or tabs and mounted in said book by stitching, stapling or the like through said strips and said edge portions, each of said panels having a shallow, elongated, rectangular cavity adjacent its spine-contiguous edge to form a pocket into which fits said strips or tabs when the book binder is closed.

2. An integrally molded book binder constructed of a thermoplastic polymer comprising:

a front cover panel, a rear cover panel, and a spine having a cross wall hingedly connected by means of living hinges along opposite longitudinal edges thereof to said front cover panel and said rear cover panel;

a first rectangular strip or tab having three free sides, extending at right angles to and longitudinally along the inner face of said spine;

a second rectangular strip or tab having three free sides, extending at right angles to and longitudinally along said inner face in a spaced, parallel relationship to said first strip or tab;

a shallow, elongated, rectangular cavity in each of said panels, adjacent the spine-contiguous edge of said panel, to form a pocket into which fits said strips or tabs when the book is closed;

a shallow, rectangular, longitudinal cavity, in the inner face of said spine, between said strips or tabs to receive the rear edges of the pages to be bound in said binder, wherein said front cover panel, said rear cover panel, said spine, said first rectangular strip or tab, and said second rectangular strip or tab are formed out of a single thermoplastic polymer molding, and said living hinges are formed from said molding;

whereby edge portions of pages of a book may be inserted between said strips or tabs and mounted in said book by stitching, stapling, or the like through said strips and said edge portions.

* * * * *

UNITED STATES PATENT AND TRADEMARK OFFICE

CERTIFICATE OF CORRECTION

PATENT NO. : 4,314,716

DATED : February 9, 1982

INVENTOR(S) : Dominic R. Errichiello

It is certified that error appears in the above-identified patent and that said Letters Patent are hereby corrected as shown below:

Column 2, line 48,

Ser. No. 63,831, filed Aug. 6, 1976 should read

-- Ser. No. 63,831, filed Aug. 6, 1979 ---

Signed and Sealed this

First Day of June 1982

[SEAL]

Attest:

GERALD J. MOSSINGHOFF

Attesting Officer

Commissioner of Patents and Trademarks